US007096961B2

(12) United States Patent
Clark et al.

(10) Patent No.: US 7,096,961 B2
(45) Date of Patent: Aug. 29, 2006

(54) METHOD AND APPARATUS FOR PERFORMING DIAGNOSTICS IN A WELLBORE OPERATION

(75) Inventors: Brian Clark, Sugar Land, TX (US); Nicolas Pacault, Houston, TX (US); Bruce W. Boyle, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 460 days.

(21) Appl. No.: 10/249,669

(22) Filed: Apr. 29, 2003

(65) Prior Publication Data

US 2004/0217880 A1 Nov. 4, 2004

(51) Int. Cl.
*E21B 19/16* (2006.01)

(52) U.S. Cl. ..... 166/380; 175/40; 340/855.2

(58) Field of Classification Search ..... 166/380, 166/65.1, 242.6; 175/40, 57; 340/855.1, 340/855.2, 853.2

See application file for complete search history.

(56) References Cited

U.S. PATENT DOCUMENTS

| | | | |
|---|---|---|---|
| 2,379,800 | A | 7/1945 | Hare |
| 2,414,719 | A | 1/1947 | Cloud |
| 3,079,549 | A | 2/1963 | Martin |
| 3,090,031 | A | 5/1963 | Lord |
| 3,387,606 | A | 6/1968 | Crafts et al. |
| 3,682,098 | A | 8/1972 | Spies |
| 3,696,332 | A | 10/1972 | Dickson, Jr. et al. |
| 3,807,502 | A | 4/1974 | Heilhecker et al. |
| 3,879,097 | A | 4/1975 | Oertke |
| 3,918,537 | A | 11/1975 | Heilhecker |
| 3,957,118 | A | 5/1976 | Barry et al. |
| 3,989,330 | A | 11/1976 | Cullen et al. |
| 3,995,209 | A | 11/1976 | Weston |
| 4,012,092 | A | 3/1977 | Godbey |
| 4,038,625 | A | 7/1977 | Tompkins et al. |
| 4,057,781 | A | 11/1977 | Scherbatskoy |
| 4,126,848 | A | 11/1978 | Denison |
| 4,176,894 | A | 12/1979 | Godbey |
| 4,196,418 | A | 4/1980 | Kip et al. |
| 4,202,490 | A | 5/1980 | Gunkel et al. |
| 4,215,426 | A | 7/1980 | Klatt |

(Continued)

FOREIGN PATENT DOCUMENTS

EP 1 158 138 A2 11/2001

(Continued)

OTHER PUBLICATIONS

US Dep't of Energy press release, *DOE Techline*, "DOE Selects California Small Business to Help Develop 'Smart Drilling System' for Oil & Natural Gas", http:www.netl.doe.gov/publications/press/1999/tl_smartdrill.html (Oct. 13, 1999).

(Continued)

*Primary Examiner*—Timothy Edwards, Jr.
(74) *Attorney, Agent, or Firm*—Jennie Salazar; James L. Kurka; Victor Segura

(57) ABSTRACT

A wired drill pipe telemetry system includes a surface computer; and a drill string telemetry link comprising a plurality of wired drill pipes each having a telemetry section, at least one of the plurality of wired drill pipes having a diagnostic module electrically coupling the telemetry section and wherein the diagnostic module includes a line interface adapted to interface with a wired drill pipe telemetry section; a transceiver adapted to communicate signals between the wired drill pipe telemetry section and the diagnostic module; and a controller operatively connected with the transceiver and adapted to control the transceiver.

53 Claims, 10 Drawing Sheets

U.S. PATENT DOCUMENTS 4,220,381 A 9/1980 van der Graaf
4,348,672 A 9/1982 Givler
4,384,288 A 5/1983 Walton
4,388,524 A 6/1983 Walton
4,445,734 A 5/1984 Cunningham
4,497,029 A 1/1985 Kiyokawa
4,533,823 A 8/1985 Vittorio
4,537,457 A * 8/1985 Davis et al. ..... 439/190
4,569,421 A 2/1986 Sandstedt
4,578,675 A 3/1986 MacLeod
4,578,991 A 4/1986 Nowlin
4,580,041 A 4/1986 Walton
4,605,268 A 8/1986 Meador
4,616,322 A 10/1986 Niwa et al.
4,628,458 A 12/1986 Ohta et al.
4,675,638 A 6/1987 Szabo
4,690,212 A * 9/1987 Termohlen ..... 166/65.1
4,698,631 A 10/1987 Kelly, Jr. et al.
4,720,626 A 1/1988 Nishikawa et al.
4,742,470 A 5/1988 Juengel
4,745,557 A 5/1988 Pekar et al.
4,780,599 A 10/1988 Baus
4,806,928 A 2/1989 Veneruso
4,818,855 A 4/1989 Mongeon et al.
4,845,493 A 7/1989 Howard
4,850,009 A 7/1989 Zook et al.
4,901,069 A 2/1990 Veneruso
4,913,227 A 4/1990 Wittrisch
4,914,433 A 4/1990 Galle
4,928,088 A 5/1990 Jorion et al.
5,008,664 A 4/1991 More et al.
5,050,675 A 9/1991 Upchurch
5,052,941 A 10/1991 Hernandez-Marti et al.
5,142,128 A 8/1992 Perkin et al.
5,202,680 A 4/1993 Savage
5,255,739 A 10/1993 Neuroth et al.
5,278,550 A 1/1994 Rhein-Knudsen et al.
5,331,318 A 7/1994 Montgomery
5,360,967 A 11/1994 Perkin et al.
5,455,573 A 10/1995 DelaTorre
5,521,592 A 5/1996 Veneruso
5,959,547 A * 9/1999 Tubel et al. ..... 340/853.2
5,971,072 A 10/1999 Huber et al.
6,011,346 A 1/2000 Buchanan et al.
6,075,461 A 6/2000 Smith
6,333,699 B1 12/2001 Zierolf
6,374,913 B1 4/2002 Robbins et al.
6,445,307 B1 9/2002 Rassi et al.
6,480,811 B1 11/2002 Denny et al.
6,615,916 B1 9/2003 Laborde
6,641,434 B1 11/2003 Boyle et al.
6,688,396 B1 * 2/2004 Floerke et al. ..... 166/380
6,816,082 B1 11/2004 Laborde
6,944,547 B1 * 9/2005 Womer et al. ..... 702/7
2001/0054969 A1 12/2001 Thomeer et al.
2002/0014966 A1 2/2002 Strassner, II et al.
2002/0039328 A1 4/2002 Dubinsky
2002/0050930 A1 5/2002 Thomeer et al.
2002/0093431 A1 7/2002 Zlerolf
2002/0112852 A1 8/2002 Floerke et al.
2002/0135179 A1 * 9/2002 Boyle et al. ..... 285/21.1
2002/0193004 A1 12/2002 Boyle et al.
2005/0027453 A1 * 2/2005 Fort et al. ..... 702/14
2005/0046591 A1 * 3/2005 Pacault et al. ..... 340/855.2

FOREIGN PATENT DOCUMENTS

GB 2289394 11/1995
RU 2040691 C1 2/1992
RU 2140537 C1 12/1997
WO WO 90/14497 11/1990
WO WO 02/06716 1/2002

OTHER PUBLICATIONS

US Dep't of Energy, *ACPT* Year-end Review Meeting and Continuation Application Review, "Cost Effective Composite Drill Pipe," Slide 25 (Aug. 31, 2000).
Hall, David R., Novatek Engineering Inc., "Telemetry Drill Pipe" (No Date).
McDonald, Wm. J. , *Offshore*, "Four Basic Systems will be Offered," pp. 96-103 (Dec. 1977).
McDonald, Wm. J. , *Oil & Gas Journal*, "Four Different Systems used for MWD," pp. 115-124 (Apr. 1978).
MJ Jellison, American Oil & Gas Reporter, Special Report: Tubulars Technology, "Tubular Innovations," pp. 50-59 (Sep. 2002) (http://www.intellipipe.com/AMOGTubulaTech.pdf).
R Martin, Wired Magazine, "Wiring the Wells," Issue 11.02, Feb. 2003 (http://www.wired.com/wired/archive/11.02/start.html?pg=9).

* cited by examiner

METHOD AND APPARATUS FOR PERFORMING DIAGNOSTICS IN A WELLBORE OPERATION

BACKGROUND OF INVENTION

1. Field of the Invention

The invention relates generally to drill string telemetry. More specifically, the present invention relates to a fault diagnosis and/or identification system for a downhole drilling operation.

2. Background Art

Downhole systems, such as Measurement While Drilling (MWD) and Logging While Drilling (LWD) systems, derive much of their value from their abilities to provide real-time information about borehole conditions and/or formation properties. These downhole measurements may be used to make decisions during the drilling process or to take advantage of sophisticated drilling techniques, such as geosteering. These techniques rely heavily on instantaneous knowledge of the formation that is being drilled. Therefore, it is important to be able to send large amounts of data from the MWD/LWD tool to the surface and to send commands from the MWD/LWD tools to the surface. A number of telemetry techniques have been developed for such communications, including wired drill pipe (WDP) telemetry.

The idea of putting a conductive wire in a drill string has been around for some time. For example, U.S. Pat. No. 4,126,848 issued to Denison discloses a drill string telemeter system, wherein a wireline is used to transmit the information from the bottom of the borehole to an intermediate position in the drill string, and a special drilling string, having an insulated electrical conductor, is used to transmit the information from the intermediate position to the surface. Similarly, U.S. Pat. No. 3,957,118 issued to Barry et al. discloses a cable system for wellbore telemetry, and U.S. Pat. No. 3,807,502 issued to Heilhecker et al. discloses methods for installing an electric conductor in a drill string.

For downhole drilling operations, a large number of drill pipes are used to form a chain between the surface Kelley (or top drive) and a drilling tool with a drill bit. For example, a 15,000 ft (5472 m) well will typically have 500 drill pipes if each of the drill pipes is 30 ft (9.14 m) long. In wired drill pipe operations, some or all of the drill pipes may be provided with conductive wires to form a wired drill pip ("WDP") and provide a telemetry link between the surface and the drilling tool. With 500 drill pipes, there are 1000 joints, each of which may include inductive couplers such as toroidal transformers. The sheer number of connections in a drill string raises concerns of reliability for the system. A commercial drilling system is expected to have a minimum mean time between failure (MTBF) of about 500 hours or more. If one of the wired connections in the drill string fails, then the entire telemetry system fails. Therefore, where there are 500 wired drill pipes in a 15,000 ft (5472 m) well, each wired drill pipe should have an MTBF of at least about 250,000 hr (28.5 yr) in order for the entire system to have an MTBF of 500 hr. This means that each WDP should have a failure rate of less than 4×10 per hr. This requirement is beyond the current WDP technology. Therefore, it is necessary that methods are available for testing the reliability of a WDP and for quickly identifying any failure.

Currently, there are few tests that can be performed to ensure WDP reliability. Before the WDP are brought onto the rig floor, these pipes may be visually inspected and the pin and box connections of the pipes may be tested for electrical continuity using test boxes. It is possible that two WDP sections may pass a continuity test individually, but they might fail when they are connected together. Such failures might, for example result from debris in the connection that damages the inductive coupler. Once the WDPs are connected (e.g., made up into triples), visual inspection of the pin and box connections and testing of electrical continuity using test boxes will be difficult, if not impossible, on the rig floor. This limits the utility of the currently available methods for WDP inspection.

In addition, the WDP telemetry link may suffer from intermittent failures that would be difficult to identify. For example, if the failure is due to shock, downhole pressure, or downhole temperature, then the faulty WDP section might recover when conditions change as drilling is stopped, or as the drill string is tripped out of the hole. This would make it extremely difficult, if not impossible, to locate the faulty WDP section.

In view of the above problems, it is desirable to have techniques for performing diagnostics on and/or for monitoring the integrity of a WDP telemetry system.

SUMMARY OF INVENTION

In one aspect, embodiments of the invention relate to a wired drill pipe diagnostic system/module. A diagnostic module for wired drill pipe in accordance with the invention includes a line interface adapted to interface with a wired drill pipe telemetry section; a transceiver adapted to communicate signals between the wired drill pipe telemetry section and the diagnostic module; and a controller operatively connected with the transceiver and adapted to control the transceiver. The diagnostic module may further comprise a power supply, an acquisition module, a sensor module, and an isolation measurement circuitry.

In one aspect, embodiments of the invention relate to a wired drill pipe having a diagnostic module. A wired drill pipe in accordance with one embodiment of the invention includes an elongated tubular shank having an axial bore; a box end at a first end of the shank, the box end having a first toroidal transformer disposed therein; a pin end at a second end of the shank, the pin end having a second toroidal transformer disposed therein; a wire electrically coupling the first and the second toroidal transformers, wherein the first toroidal transformer, the second toroidal transformer, and the wire constitute a telemetry section of the wired drill pipe; and a diagnostic module electrically coupled to the telemetry section of the wired drill pipe, wherein the diagnostic module comprising a line interface adapted to interface with a wired drill pipe telemetry section; a transceiver adapted to communicate signals between the wired drill pipe telemetry section and the diagnostic module; and a controller operatively connected with the transceiver and adapted to control the transceiver.

In one aspect, embodiments of the invention relate to a wired drill pipe telemetry system. A wired drill pipe telemetry system in accordance with one embodiment of the invention includes a surface computer; and a drill string telemetry section comprising a plurality of wired drill pipes each having a telemetry section, at least one of the plurality of wired drill pipes having a diagnostic module electrically coupling the telemetry section and wherein the diagnostic module includes a line interface adapted to interface with a wired drill pipe telemetry section; a transceiver adapted to communicate signals between the wired drill pipe telemetry section and the diagnostic module; and a controller operatively connected with the transceiver and adapted to control the transceiver.

In one aspect, embodiments of the invention relate to a method for diagnosing a wired drill pipe telemetry system that includes a plurality of wired drill pipes, each having a telemetry section, and at least one of the plurality of the wired drill pipes having a diagnostic module. A method in accordance with one embodiment of the invention includes sending a polling signal from a surface computer to the wired drill pipe telemetry system, the polling signal including a selected identifier; receiving and processing the polling signal by the diagnostic module in the at least one of the plurality of wired drill pipes; and receiving by the surface computer a reply from a specific diagnostic module having the selected identifier.

In one aspect, embodiments of the invention relate to methods for determining coupling efficiencies of wired drill pipes in a drill string. A method in accordance with one embodiment of the invention includes instructing each of at least one diagnostic module of the wired drill pipes in the drill string to send a signal of a known magnitude to a surface computer; receiving the signal with a measured magnitude for the each of the at least one diagnostic module; and determining the coupling efficiencies of the wired drill pipes based on the measured magnitude of the signal.

Finally, in another aspect, the invention relates to a method of testing a telemetry section. The section comprises a drill pipe having a wire extending therethrough. The method comprises providing a telemetry section with a test pad and a resistor, the resistor having a known resistance, applying a voltage between a test pad and the drill pipe, measuring a test resistance passing between the test pad and the drill pipe, and detecting a difference between the test resistance and the known resistance whereby the condition of the wired drill pipe is determined.

Other aspects of the invention will become apparent from the following description, the drawings, and the claims.

DETAILED DESCRIPTION

Embodiments of the present invention relate to wired drill pipe (WDP) diagnostic systems/modules (DSM). A DSM in accordance with the invention may comprise, for example, a transceiver and a controller or a simple state machine integrated into a chip. Each DSM can respond to a poll from a surface computer and provide information, such as the status of the section of the WDP. Using embodiments of the invention, the connection to each WDP can be confirmed, and any failure in the drill string can be immediately located. In addition, the DSM may also include a unique identifier to facilitate identification, inventory and maintenance of the WDP. The identification system can also be used to provide an automatic tally book.

Figure 1:
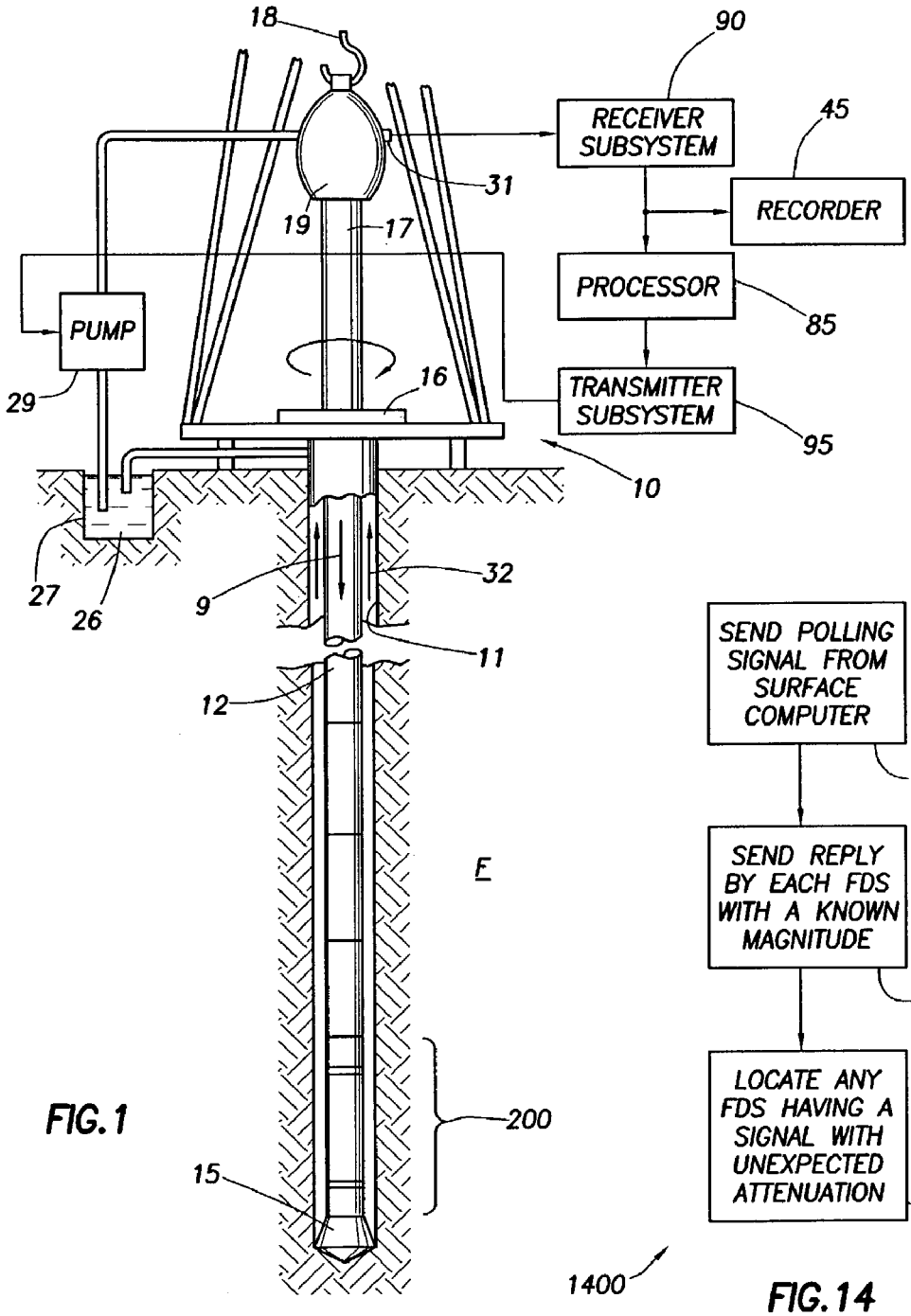
FIG. 1 shows a conventional MWD drilling tool disposed in a wellbore penetrating an earth formation.

FIG. 1 illustrates a conventional drilling rig and drill string in which the present invention can be utilized to advantage. As shown in FIG. 1, a platform and derrick assembly 10 is positioned over wellbore 11 penetrating subsurface formation F. A drill string 12 is suspended within wellbore 11 and includes drill bit 15 at its lower end. Drill string 12 is rotated by rotary table 16, energized by means not shown, which engages kelly 17 at the upper end of the drill string. Drill string 12 is suspended from hook 18, attached to a traveling block (not shown), through kelly 17 and rotary swivel 19 which permits rotation of the drill string relative to the hook.

Drilling fluid or mud 26 is stored in pit 27 formed at the well site. Pump 29 delivers drilling fluid 26 to the interior of drill string 12 via a port in swivel 19, inducing the drilling fluid to flow downwardly through drill string 12 as indicated by directional arrow 9. The drilling fluid exits drill string 12 via ports in drill bit 15, and then circulates upwardly through the region between the outside of the drillstring and the wall of the wellbore, called the annulus, as indicated by direction arrows 32. In this manner, the drilling fluid lubricates drill bit 15 and carries formation cuttings up to the surface as it is returned to pit 27 for recirculation.

Drillstring 12 further includes a bottom hole assembly (BHA) 200 disposed near the drill bit 15. BHA 200 may include capabilities for measuring, processing, and storing information, as well as communicating with the surface (e.g., MWD/LWD tools). An Example of a communications apparatus that may be used in a BHA is described in detail in U.S. Pat. No. 5,339,037.

The communication signal from the BHA may be received at the surface by a transducer 31, which is coupled to an uphole receiving subsystem 90. The output of receiving subsystem 90 is then couple to processor 85 and recorder 45. The surface system may further include a transmitting system 95 for communicating with the downhole instruments. The communication link between the downhole instruments and the surface system may comprise, among other things, a drill string telemetry system that comprises a plurality of WDPs.

One type of WDP, as disclosed in U.S. Patent Application No. 2002/0193004 by Boyle et al. and assigned to the assignee of the present invention, uses inductive couplers to transmit signals across pipe joints. An inductive coupler in the WDPs, according to Boyle et al., comprises a transformer that has a toroid core made of a high permeability, low loss material such as Supermalloy (which is a nickel-iron alloy processed for exceptionally high initial permeability and suitable for low level signal transformer applications). A winding, consisting of multiple turns of insulated wire, winds around the toroid core to form a toroid transformer. In one configuration, the toroidal transformer is potted in rubber or other insulating materials, and the assembled transformer is recessed into a groove located in the drill pipe connection.

Figure 2:
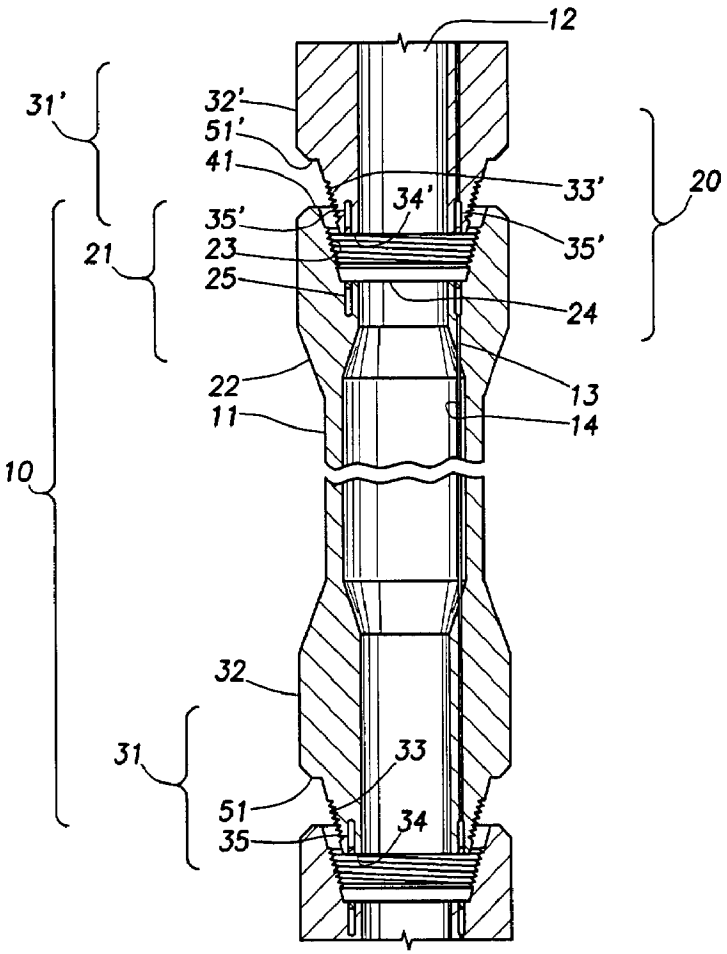
FIG. 2 shows a wired drill pipe in accordance with one embodiment of the invention.

FIG. 2 shows an example of a wired drill pipe 10, as disclosed in the Boyle et al. application. In this example, the wired drill pipe 10 has a shank 11 having an axial bore 12, a box end 22, a pin end 32, and a wire 14 running from the box end 22 to the pin end 32. A first current-loop inductive coupler element 21 (e.g., a toroidal transformer) and a second current-loop inductive coupler element 31 are disposed at the box end 22 and the pin end 32, respectively. The first current-loop inductive coupler element 21, the second current-loop inductive coupler element 31, and the wire 14 within a single WDP form a "telemetry connection" in each WDP. Inductive coupler 20 (or "telemetry connection") at a pipe joint is shown as constituted by a first inductive coupler element 21 from one pipe and a second current-loop inductive coupler element 31' from the next pipe.

In this description, a "telemetry connection" defines a connection at a joint between two adjacent pipes, and a "telemetry section" refers to the telemetry components within a single piece of WDP. A "telemetry section" may include inductive coupler elements and the wire within a single WDP, as described above. However, in some embodiments, the inductive coupler elements may be replaced with some other device serving a similar function (e.g., direct electrical connections). In some embodiments of the invention, a WDP may further include a diagnostic module operatively coupled to one or more telemetry sections to facilitate diagnosis, inventory, and/or maintenance of the WDP. When a plurality of such WDPs are made up into a drill string, the telemetry components are referred to as a "telemetry link." That is, a drill string "telemetry link" or a WDP "telemetry link" refers to an aggregate of a plurality of WDP "telemetry sections." When other components such as a surface computer, an MWD/LWD tool, and/or routers are added to a WDP "telemetry link," they are referred to as a "telemetry system." A surface computer as used herein may comprise a computer, a surface transceiver, and/or other components.

Figure 3:
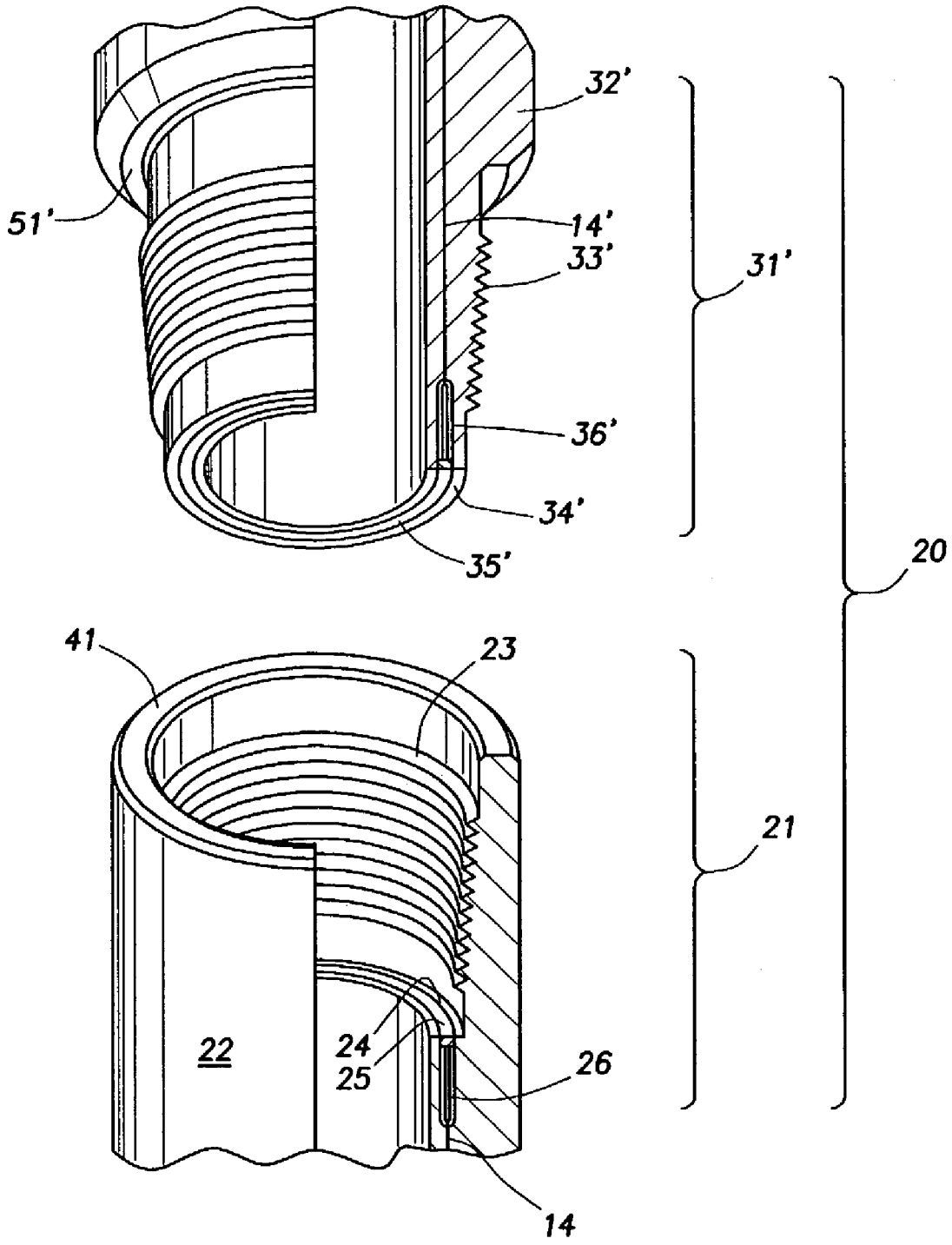
FIG. 3 shows a box and a pin connection of a wired drill pipe in accordance with one embodiment of the invention.

As shown in FIG. 3, box-end 22 includes internal threads 23 and an annular inner contacting shoulder 24 having a first slot 25, in which a first toroidal transformer 26 is disposed. The toroidal transformer 26 is connected to the wire 14. Similarly, pin-end 32" of an adjacent wired pipe includes external threads 33" and an annular inner contacting pipe end 34" having a second slot 35", in which a second toroidal transformer 36" is disposed. The second toroidal transformer 36" is connected to wire 14" of the adjacent pipe. The slots 25 and 35" may be clad with a suitable material (e.g., copper) to enhance the efficiency of the inductive coupling.

Figure 4:
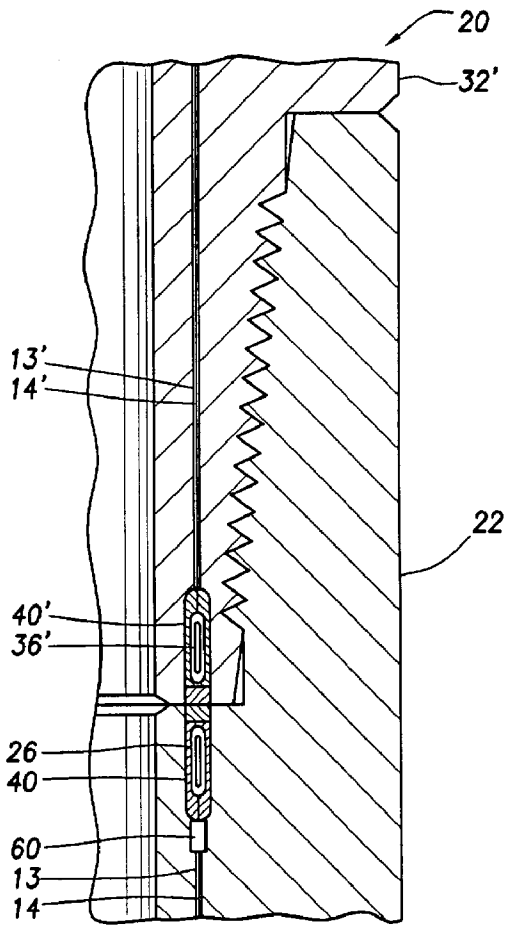
FIG. 4 is a cross-section view of a wired drill pipe joint in accordance with one embodiment of the invention.

When the box end 22 of one WDP is assembled with the pin end 32" of the adjacent WDP, a pipe and or telemetry connection is formed. FIG. 4 shows a cross section of a portion of the joint, in which a facing pair of inductive coupler elements (i.e., toroidal transformers 26, 36") are locked together as part of an operational pipe string. This cross section view also shows that the closed toroidal paths 40 and 40" enclose the toroidal transformers 26 and 36", respectively, and conduits 13 and 13" form passages for internal electrical wires/cables 14 and 14" that connect the two inductive coupler elements disposed at the two ends of each WDP.

Also shown in FIG. 4 is a DSM, in this case a small electronic module 60, that is added to each WDP such that the electronic module 60 can communicate with the surface system over the WDP telemetry link. Each electronic module 60 may also store a unique identifier for the particular WDP. The surface computer can poll the electronic module 60 for this identifier via the WDP telemetry link. While such a system is referred to as a diagnostic system/module (DSM) in this description, it may serve various purposes, such as fault diagnosis, identification, sensing, measurement, and/or location, among others. Furthermore, one skilled in the art would appreciate that the identifiers as used in the description are not limited to "numbers." Rather, the use of alphabets, alphanumeric, binary codes, and other identifiers is expressly within the scope of the invention.

Figure 5B:
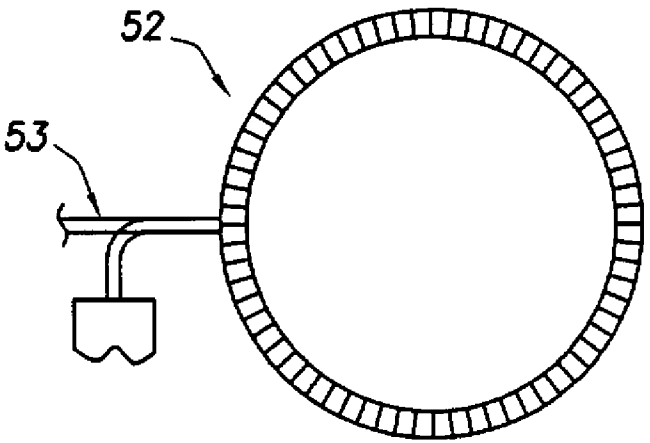
FIGS. 5A and 5B show two schematics for connecting a DSM to a WDP telemetry section in accordance with one embodiment of the invention.
Figure 5A:
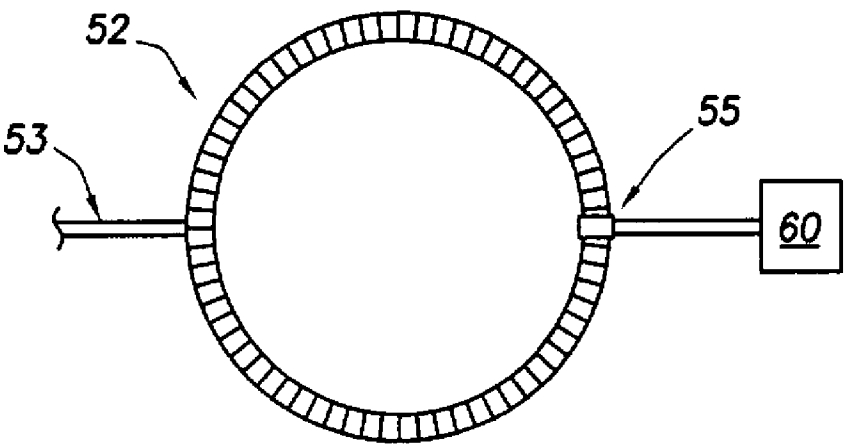

FIGS. 5A and 5B show two possible configurations for linking the DSM with a WDP telemetry section. In FIG. 5A, the DSM 60 is separate from the main transmission circuit 53. In this configuration, a small amount of power may be drawn by the DSM 60 from the WDP toroid 52 by wrapping a secondary winding 55 on the core. With this configuration, an open circuit in the secondary circuit (the DSM 60) will not affect the primary circuit 53. On the other hand, a short in the secondary circuit may cause a failure of normal transmission in the WDP telemetry.

However, this potential problem can be minimized or prevented by placing a high impedance or a capacitive coupling (not shown) close to the DSM circuit 60.

In another embodiment shown in FIG. 5B, the DSM 60 is not separate from the main transmission circuit 53. A small amount of power may be drawn by the DSM 60 from the WDP toroid transformer 52 by connecting the DSM 60 directly to the WDP wires 53. As compared with the embodiment shown in FIG. 5A, this design has an advantage in that for a given WDP input voltage, the DSM input voltage will be higher (higher turn ratio). This will render the DSM hardware implementation simpler and more robust.

Note that with either configuration shown in FIG. 5A or FIG. 5B, even if a WDP telemetry section failure generates a telemetry system failure, the failure can still be easily located because none of the DSM's below the failed telemetry section will respond to the poll from the surface WDP transceiver (or surface computer).

The dimensions of the DSM electronic module are preferably small such that it may fit in the same groove (shown as 25 in FIG. 3), in which the toroidal transformer is disposed. However, other configurations, in which the DSM is disposed outside the groove, are expressly within the scope of the invention. For example, the DSM may be located in a cavity next to the groove (as shown in FIG. 4) or somewhere else in the WDP. The DSM module may be a multi-chip module, ASIC, or other small package. It is also preferred that the electronics can operate at hydrostatic pressures expected in the downhole environment, if the DSM is embedded in rubber. Alternatively, the DSM may be enclosed in a small container to isolate it from the downhole pressure.

Figure 6:
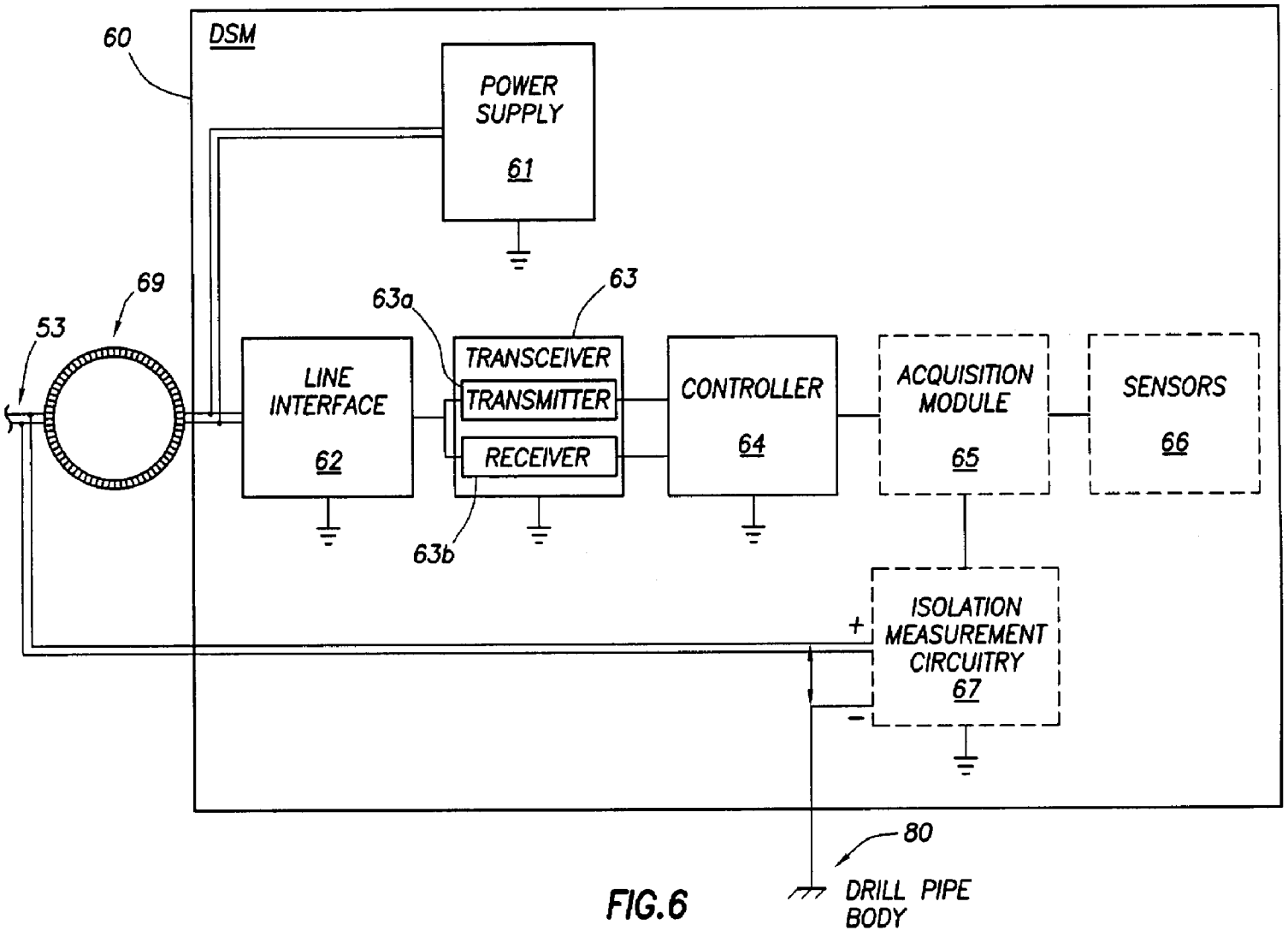
FIG. 6 shows a schematic of a DSM in accordance with one embodiment of the invention.

FIG. 6 shows a DSM in accordance with one embodiment of the invention. In this embodiment, the DSM 60 comprises a power supply 61, line interface 62, a transceiver 63, and a controller 64. As used herein, the "controller" may also be a simple state machine. In addition, the DSM 60 may optionally include an acquisition module 65, sensors 66, and isolation measurement circuitry 67, as shown in the dashed boxes in FIG. 6.

The power supply 61 provides the power needed to operate the DSM 60. As noted above, the DSM may draw power from the WDP toroidal transformer either by wrapping a secondary coil on the WDP toroid (FIG. 5A) or by directly connecting to the WDP wires (FIG. 5B). Alternatively, the DSM may be powered by batteries, turbines or other external sources. Preferably, the power supply for the circuitry is able to generate a few volts DC even with very low input voltages, and the power drawn by the DSM in the idle mode should be minimal to reduce transmission losses in the drill string.

The line interface 62, which may include an input transformer, functions to bridge the DSM circuitry 60 with the WDP telemetry system 69. The transceiver 63 includes a transmitter 63*a* for transmitting identifier signals to the surface computer and a receiver 63*b* for receiving polling signals from the surface computers.

Normally, the DSM 60 will be in a low power listening mode (idle mode). When the surface computer (not shown) issues a poll for a specific identifier, every DSM in the WDP telemetry link may receive (via receiver 63*b*) and process the polling signal. However, only the DSM with the matching identifier would respond and transmit a reply to the surface computer (via transmitter 63*a*). Alternatively, each DSM may respond with its own identifier or some indicator signal (match or no match). The power consumption may increase during the brief transmission period.

One way to implement the communication between the WDP surface unit and the DSM, for example, would be to feed a selected level of power (e.g., 10 W to 100 W) from the surface computer to the WDP telemetry system and use a proper modulation scheme to control the uplink (communication from the DSM to the surface unit) and downlink (communication from the surface unit to the DSM) traffic. For example, the WDP surface unit may send an AC power to the WDP telemetry system and the commands sent to the DSM's may be encoded by modulating the line voltage using a technique such as amplitude modulation, frequency shift keying, and the like. The DSM would send data back to the surface computer by a different modulation scheme, e.g., by modulating the current drawn by the WDP using a transistor switch. One of ordinary skill in the art would appreciate that other ways of implementing the communication and signal modulation/encoding are possible and would not depart from the scope of the invention.

The controller 64, as shown in FIG. 6, may include programmable logic devices (e.g., field programmable gate array, FPGA), capacitors (e.g., microprocessors, controllers, etc.), other digital components, and peripherals. The functions of the controller 64, for example, may include control of the signal modulation/demodulation, protocol handling, control of peripherals (e.g., measurement circuitry and memory), and the like.

In addition to the above components, the DSM 60 may also include an acquisition module 65 and a sensor module 66, which may be used to measure shocks, pressure, or temperature, for example. Downhole temperature normally will be related to the depth and the geothermal profile. However, friction between the drill pipe and formations or casing may result in abnormal temperatures. Thus, an unusually high temperature for a particular section of WDPs may indicate excessive friction, which would shorten the lifetime of the section. Similarly, shocks may also negatively impact the lifetime of a WDP. Shocks induced by harsh drilling could be detected by an accelerometer using predefined thresholds. The surface computer could poll the DSM's, and the DSM's may initiate such measurements and send the results to the surface computer in real time. It is also possible to store results in a permanent memory for later read-out. Such data may be used to schedule inspection and maintenance of the WDP, and to inform, in real-time, the operator of possible problems (high shock levels, high friction) that could damage the drill string.

In addition, the DSM 60 may also include other modules for other desired functions. For example, an isolation measurement circuitry 67 may be included in the DSM 60 for checking the isolation between the WDP wires and the pipe.

Figure 7A:
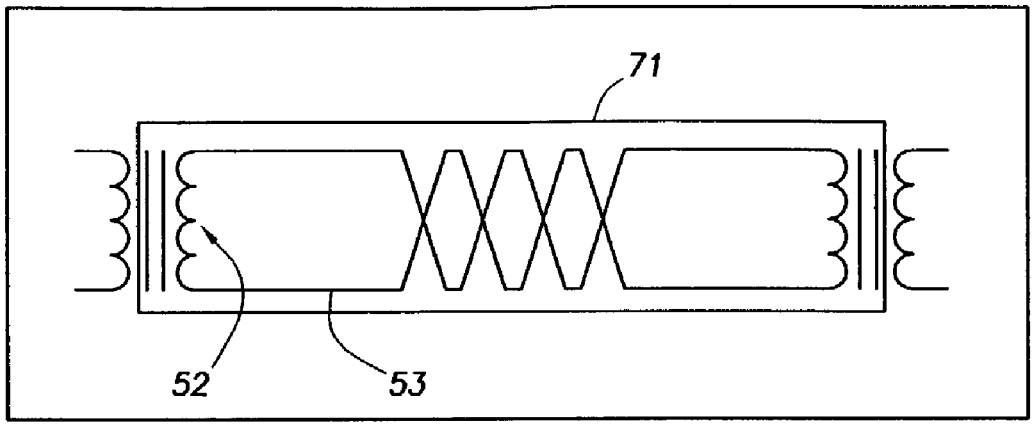
FIG. 7A shows a schematic of a WDP telemetry section in a sealed compartment.

As shown in FIG. 7A, in a typical WDP, the wires 53 are sealed and positioned in a compartment 71 to protect them from the harsh downhole environment. This makes it difficult to check the isolation between the WDP wires and the pipe. One solution is to add an isolation testing connection that can provide an access to the WDP wire 53 or the WDP toroid 52 for inspection (e.g., testing isolation between the WDP wire 53 and the WDP body), but would be sealed during drilling. However, such an isolation testing connection decreases the reliability and increases the price of a WDP.

Figure 7B:
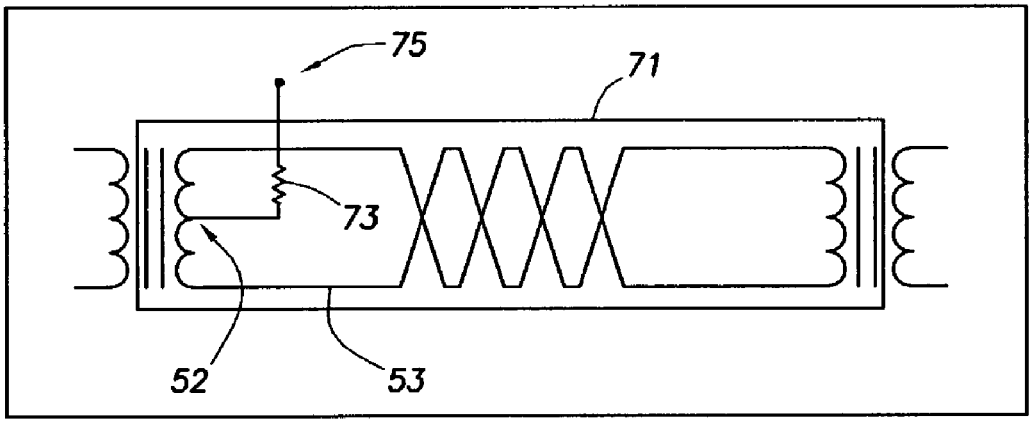
FIG. 7B shows a schematic of a WDP telemetry section having an isolation testing connection in accordance with one embodiment of the invention.
Figure 8A:
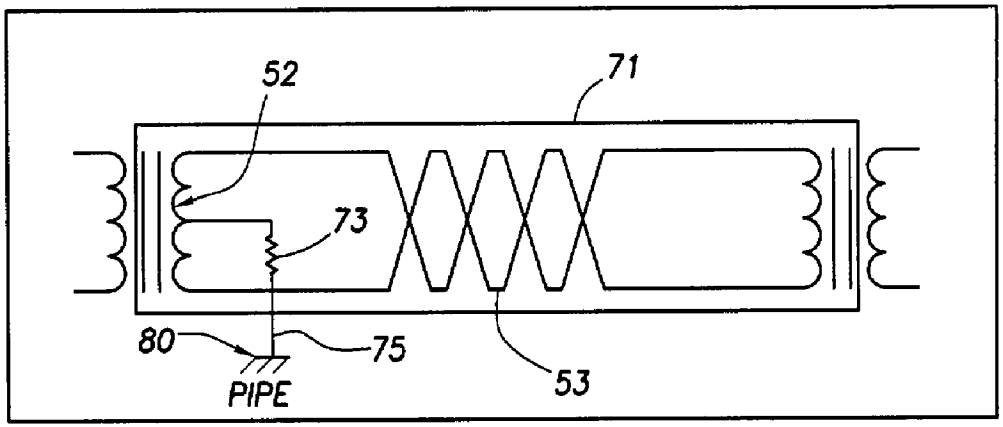
FIG. 8A shows a schematic of a WDP telemetry section having an isolation testing connection with a high ohmic resistor in accordance with one embodiment of the invention.
Figure 8B:
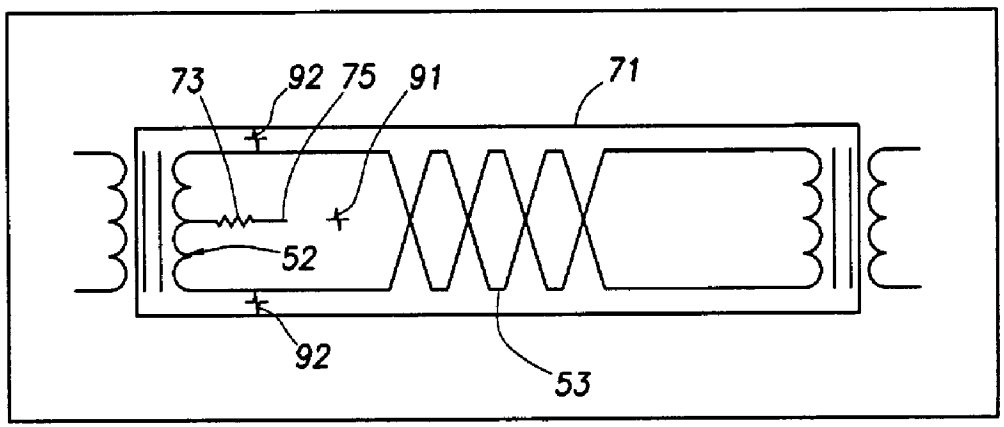
FIG. 8B shows a schematic of common noises in a WDP telemetry section having an isolation testing connection with a high ohmic resistor in accordance with one embodiment of the invention.

An alternative solution is to connect a high ohmic resistor 73 (e.g., 1–10 M Ω) to the WDP toroid 52 or WDP wire 53 on one end and to a test pad 75 on the other end, as shown in FIG. 7B. An isolation testing connection as shown in FIG. 7B includes the test pad 75, a high ohmic resistor 73 and conductive wires linking the test pad 75 and the resistor 73 to the WDP toroid 52. The high ohmic resistor 73 between the test pad 75 and the WDP toroid 52 or WDP wire 53 makes it possible to leave the test pad exposed to the downhole environment without affecting the telemetry signals. Because there is no need to seal the test pad 75, it can be shorted to the ground (or pipe body) 80 as shown in FIG. 8A. As shown in FIG. 8A, even though the test pad 75 is exposed or connected to pipe body 80, it will not affect the WDP telemetry because the high ohmic resistor 73 essentially prevents current flow. In addition, as shown in FIG. 8B, if any noise 91 gets into the system from the test pad 75, it will pass to the WDP wires 53 as common-mode noises 92 which can be easily filtered.

Figure 7C:
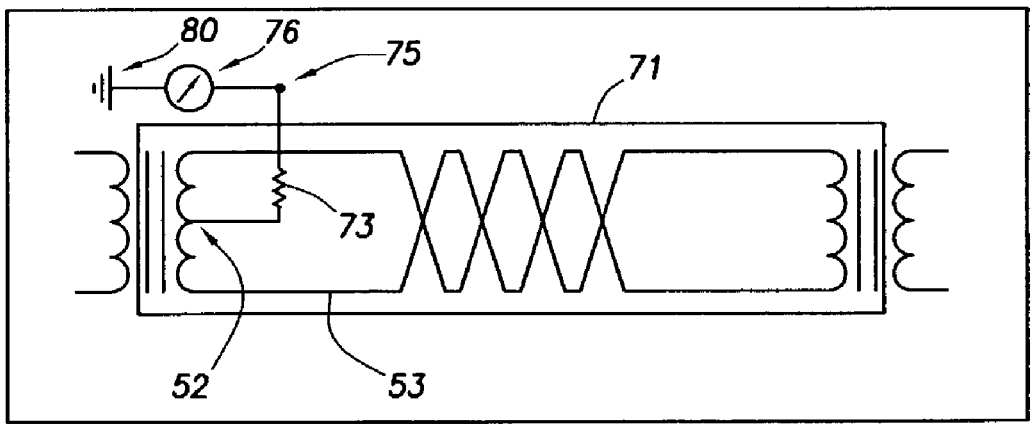
FIG. 7C shows a schematic of testing a WDP telemetry section having an isolation testing connection in accordance with one embodiment of the invention.

FIG. 7C shows a method to test the existence of any short between the WDP wire 53 and the pipe body 80. With the configuration shown in FIG. 7B, a high voltage 76 (e.g., 500–1000V DC) may be applied between the test pad 75 and the pipe body 80. The current (hence, resistance) thus measured can be used to indicate whether a short between the WDP wire 53 and the pipe body 80 has occurred.

Figure 9:
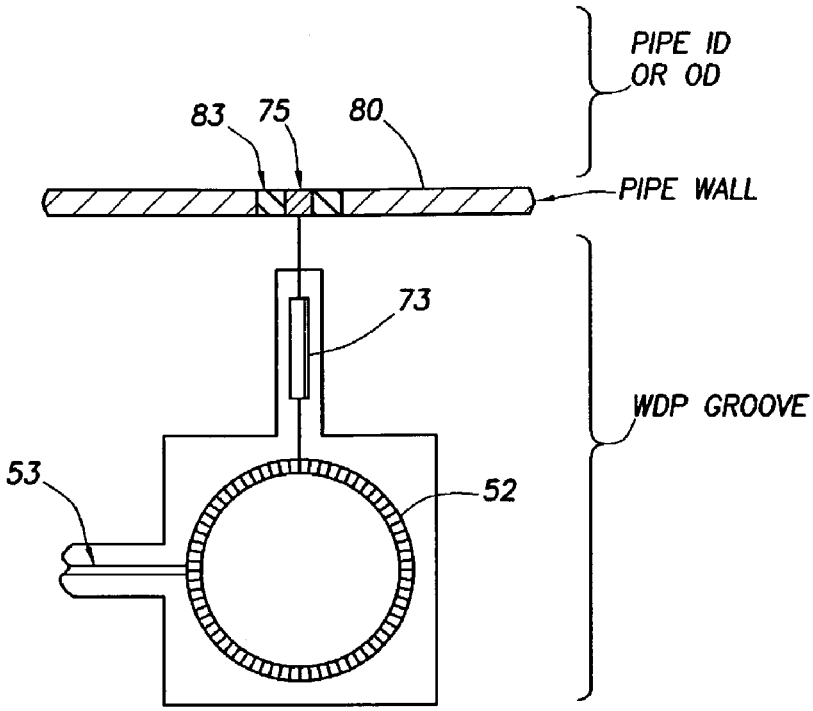
FIG. 9 shows a schematic of a WDP telemetry section having an isolation testing connection with a high ohmic resistor in accordance with one embodiment of the invention, wherein the test pad of the isolation testing connection is exposed on the pipe wall.

As noted above, with a high ohmic resistor 73, the test pad can be exposed to the environment. This greatly simplifies the design of WDPs. FIG. 9 illustrates one example of an isolation test pad 75 disposed on a pipe wall 80. The test pad 75 is isolated from the pipe wall 80 by the surrounding non-conductive material 83, while the test pad 75 is connected to a toroidal transformer 52 via a high ohmic resistor 73.

Figure 10:
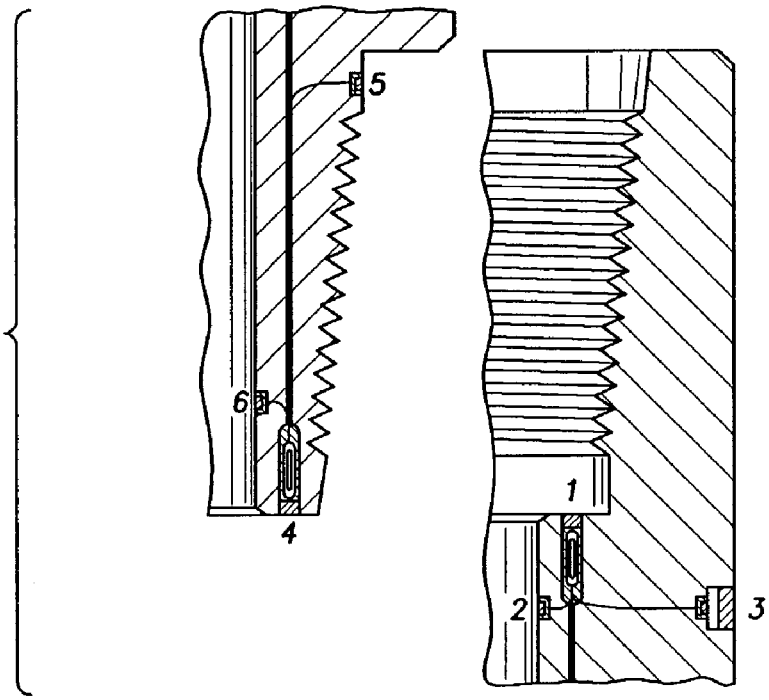
FIG. 10 illustrates various locations for disposing the test pad of an isolation testing connection in accordance with one embodiment of the invention.

FIG. 10 illustrates several possible configurations in a wired drill pipe design to include a test pad 75 shown in FIG. 9. For example, the test pad (electrode) 75 may be embedded in the insulating material adjacent to the toroidal coils at locations 1 and 4. This would minimize the machining required and eliminate the need for additional non-conductive material. Alternatively, the test pad 75 could be placed on the inner wall of the drill pipe at locations 2 and 6, on the outer wall (e.g., at location 3) or on the outside of the pin shank (e.g., at location 5). If it is desirable to protect the test pad from the environment during operation, the test pad 75 may be placed in a pocket with a sealing plug, as shown at location 3, or in the form of a pigtail with an elastomer boot (not shown).

An alternative approach to testing the isolation between the drill pipe and the WDP wire is to include an isolation measurement circuitry. As shown in FIG. 6, an isolation measurement circuitry 67 may be included as part of the DSM 60 for checking the isolation between the WDP wire 53 and the pipe body 80. Because the DSM 60 can be sealed in a compartment, there is no need to use a high resistance in the connection between the WDP wire 53 and the pipe body 80. In addition, the measurement may be performed in real time and can provide early signs of insulation damages. Preventive actions may then be taken before a major system failure occurs.

While the above description implies that the WDP telemetry system works in a simple series, this is not necessary. In fact, in a linear configuration, there may be a limitation on how many WDP DSM can respond directly to the surface computer.

Figure 11A:
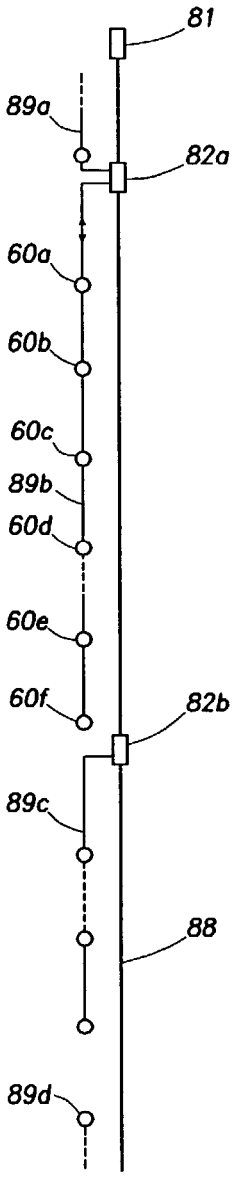
FIG. 11A shows a schematic of a WDP telemetry system arranged in a network in accordance with one embodiment of the invention.

Assuming a signal loss of 0.2 dB per connection, and a 15,000 ft (4572 m) drill string, the total attenuation for 500 WDP's is 100 dB. This problem can be solved by adding routers (which are relays and amplifiers) in the drill string to boost transmission FIG. 11A shows an example of one embodiment of the invention, in which the WDP telemetry system is implemented in a network configuration. In the example shown in FIG. 11A, the surface computer 81, the routers 82*a*, 82*b*, and the MWD/LWD tool may form a master network (node) 88, while the DSMs are grouped into sub-networks 89*a* 89*c*. Each DSM sub-network may comprise several DSMs, e.g., DSM 60*a* 60*f* shown in sub-network 89*b*.

In a typical implementation, a router may be added every 100–200 pipes depending on the system efficiency. For example, in FIG. 11A, the network architecture includes two routers 82*a* and 82*b*. The function of WDP routers 82*a* and 82*b* are to relay data transmitted by the WDP surface unit 81 to the WDP MWD tool 83 and/or to the DSMs (e.g., 60*a* 60*f*), and vice versa. Routers 82*a* and 82*b* may also function to boost signal transmission. The WDP routers 82*a* and 82*b* could be battery powered or turbine powered.

A network may be configured in a bus topology (with the WDP surface unit 81 is the master and the DSMs are the slaves), a ring topology (e.g., "daisy-chain" of DSMs), or the like. In the embodiment shown in FIG. 11A, the WDP routers 82*a* and 82*b*, the MWD tool 83, and WDP surface unit 81 are nodes of a first network 88, while the DSMs are nodes of sub-networks 89*a* 89*d*. For example, DSMs 60*a* 60*f* form the sub-network 89*b*. In this embodiment, the communication from the WDP surface unit 81 to the DSMs 60*a* 60*f* is no longer a "straight line," but through routers 82*a*.

Figure 11B:
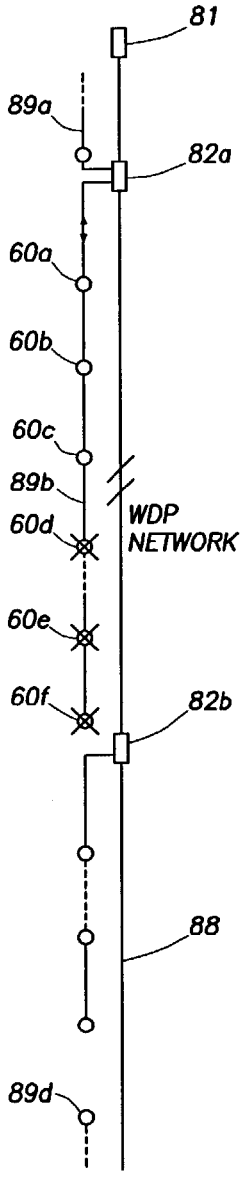
FIG. 11B illustrates a failure in one WDP telemetry section with a WDP telemetry system in accordance with one embodiment of the invention.
Figure 11C:
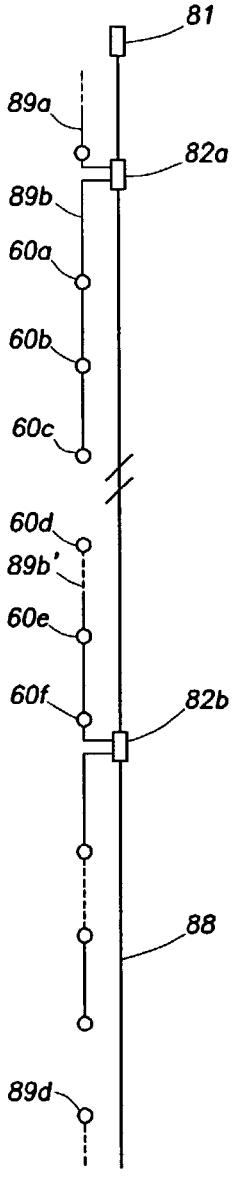
FIG. 11C illustrates reconfiguration of the WDP telemetry network to overcome a failure in a WDP telemetry section in accordance with one embodiment of the invention.

In addition, the network communication may be reconfigured (by the user or transparently by the communication protocol) when communication errors occur at a particular WDP telemetry section. For example, if the WDP joint between DSM 60*c* and DSM 60*d* has high loss, DSMs 60*d* 60*f* will no longer be able to communicate through router 82*a*, as shown in FIG. 11B. In this case, DSMs 60*d* 60*f* may be reconfigured as sub-network 89*b*" to communicate through router 82*b*, as shown in FIG. 11C. Thus, these routers may also provide fault tolerance.

In addition to the bus topology shown in FIGS. 11A–11C, a network may be configured in a "daisy-chain" (ring network topology). In a ring topology, some of the WDP DSMs may be designed to detect a response from lower sections, and retransmit it. This configuration may eliminate the need for batteries and amplifiers because the distance between the links of the daisy chain can be quite short and there will be no need for high power transmission. For example, if there is one relay for every 50 sections of WDP, then the maximum signal attenuation between relays is a modest 10 dB.

In a network implementation, the WDP DSMs of the invention may be adapted to a variety of telemetry protocols (custom protocols or standard protocols). For example, the mode of transmission may be based on any modulation technique known in the art, such as amplitude modulation (AM), frequency shift keying (FSK), phase shift keying (PSK), and the like. The WDP DSM may be adapted to various transmission rates, e.g., from a few baud to tens of thousands of baud. Data transmission between the DSM and the surface computer may be encoded with any known encoding techniques, such as Manchester phase encoding, differential Manchester encoding, or any other encoding. Communications between the DSMs and the routers, or other components of the telemetry system, may be mediated by the WDP wires, by wireless communications, or by other suitable means (e.g., mud pulse telemetry).

The present invention has several advantages. Some of these advantages are illustrated in the following exemplary applications.

Figure 12:
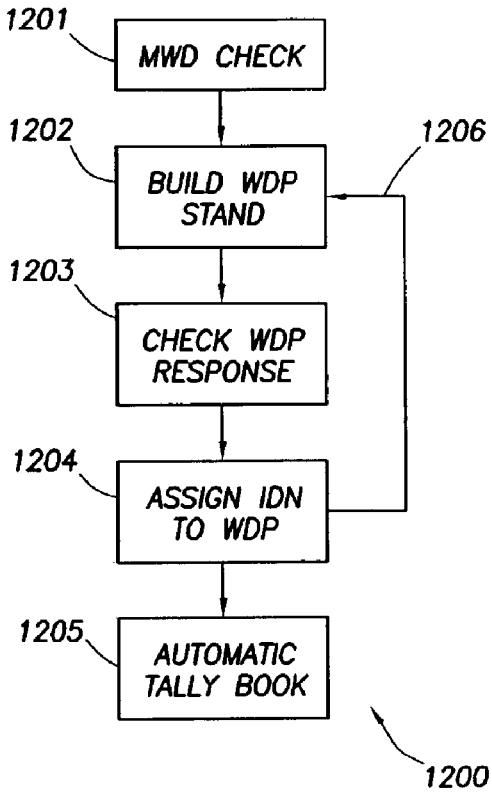
FIG. 12 shows a flow chart of a method for automatically building a tally book in accordance with one embodiment of the invention.

For example, the WDP DSMs of the invention may be used to monitor and log drill pipes as they are run in hole. FIG. 12 illustrates a method for automatically tallying the drill pipes when they are run in hole using a WDP DSM of the invention.

As shown in FIG. 12, a method 1200 for using a WDP telemetry system to automatically tally the drill pipes during a trip into the hole may involve the following steps. First, the MWD or LWD tools are made up and checked for proper communication with the surface computer (step 1201). The proper communication may be checked by sending a polling signal from the surface computer to the MWD or LWD tools, and the tools respond. Next, a stand of WDP is made up and run in hole (step 1202). The surface computer instructs the stand of WDP to respond (step 1203). Prior to this, the surface computer may run through the identifiers for all WDP shipped to the rig to have all identifiers stored in the memory. When the surface computer receives a reply from the WDP with the requested identifier, it assigns that identifier to the stand of WDP (step 1204). A stand of WDP may comprise multiple (e.g., three) sections of WDP. It may (or may not) be possible to associate a specific identifier with a specific WDP located within that particular stand of WDP.

Steps 1202–1204 are repeated (step 1206) until the drill string is complete, i.e., the tools reach the bottom of the borehole. This process establishes the relative position of each stand in the drill string. With the length of each WDP known and stored in a database, it becomes possible to locate the depth of each WDP in the borehole. This could be used to create an automatic tally book (step 1205). The automatic tally would reduce depth errors commonly associated with manual tally. This information may also be used later to locate any failure in the drill string. In the tally book, the WDP DSM may also log the time of each WDP in use and the temperature or shock exposure history of each WDP (e.g., using the acquisition module 65 and sensor module 66 shown in FIG. 6), or similar information.

Once the drill bit reaches the bottom of the hole, the WDP DSM system may be used to perform various diagnostic and measurement functions. For example, a process of verifying that each WDP is functioning properly during a logging operation is illustrated in FIG. 13.

Figure 13:
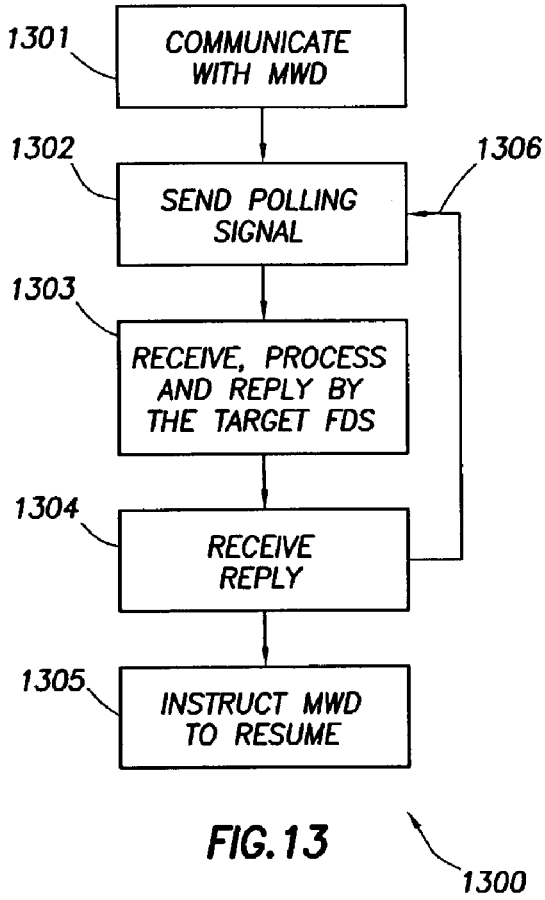
FIG. 13 shows a flow chart of a method for polling each DSM in a WDP telemetry system in accordance with one embodiment of the invention.

As shown in FIG. 13, a method 1300 for checking the proper functioning of each WDP may include the following steps. First, the surface computer may instruct the MWD or LWD tools to transmit MWD or LWD data (step 1301). This is the normal data flow. When the system needs to verify the WDP telemetry system, it communicates to the MWD or LWD tools to go into listening mode (step 1301). Next, the surface computer then sends a command (polling signal) to a specific WDP DSM (e.g., 20015) (step 1302). There is no other traffic on the WDP telemetry system at this time. The polling signal from the surface computer may be received and processed by every DSM. However, only the WDP with DSM 20015 responds (step 1303). Other WDPs may also receive and process the request, but do not respond. The surface computer listens for the response from DSM 20015 and records whether it is received (step 1304). A time period for response may be pre-set, and if no response is received within the pre-set period, a failure to respond may be presumed.

In an alternative embodiment, if the DSM is too far removed from the surface computer to be heard, the MWD or LWD tools may serve as a relay to the surface computer. In this alternative embodiment, an MWD or LWD tool also listens for the response from DSM 20015. If it receives the response, it waits until the pre-set time period expires. Then, the MWD or LWD tool transmits a message to the surface computer indicating whether it detected the response from DSM 20015. This verifies whether the DSM is working and whether the transmission system is functional in both directions.

The surface computer polls the next DSM (e.g. 20039). This process is repeated (step 1306) until some or all of the WDP are polled. Note that it is not necessary to poll all of the WDP DSMs all the times. Strategic sampling of a few physically separated WDP DSMs is a better approach. Finally, the surface computer instructs the MWD or LWD tools to resume transmitting MWD and LWD data (step 1305).

Locating Failures During Well Site Operations

Certain circumstances would justify polling the WDP DSM. For example, the surface computer would poll the WDP DSM during the trip into the well run in hole (RIH) and when adding drill pipe while drilling ahead. The surface computer could also poll the WDP DSM periodically during drilling to verify their proper operation and the integrity of the transmission system, according to the method shown in FIG. 13.

If there is a hard failure, the surface computer can communicate to all WDP DSMs down to the point of failure and thus locate it. If there are intermittent failures, then the surface computer can periodically poll WDP DSMs to locate the troublesome WDP, or it can poll as soon as a failure is detected. Once the failure is located, the drill string may be rapidly tripped out to the point of failure. Fast tripping with elevators may be preferred over a trip where the Kelley or top drive is attached to each stand of WDP. During such a fast trip, the surface transceiver would not be attached to the WDP string.

Another potential problem with WDP is that certain sections may suffer reduced coupling efficiencies but not a hard failure. For example, the transformer core might be damaged or the copper clad groove might be corroded, resulting in a loss greater than expected (e.g., >0.2 dB). Such losses might be affected by the downhole environment, making them difficult to find under surface conditions. However, with embodiments of the invention, the efficiency of each WDP connection can be monitored in real time, and any problem that exists only in the downhole environment may be easily identified.

Figure 14:
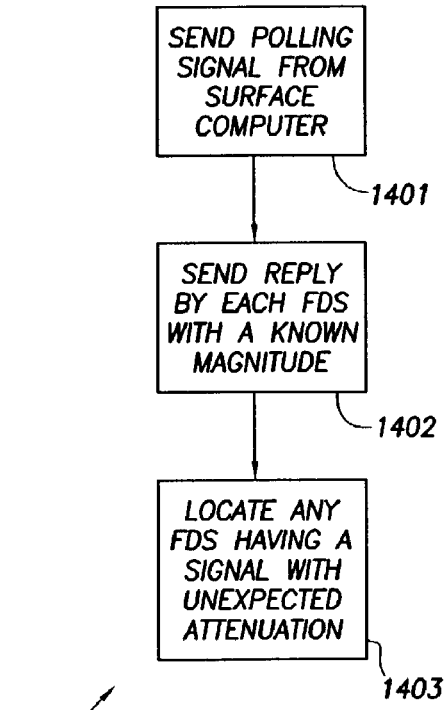
FIG. 14 shows a flow chart of a method for assessing coupling efficiency of each WDP telemetry in a drill string in accordance with one embodiment of the invention.

FIG. 14 shows a method 1400 that illustrates how to identify a problem using a DSM of the invention. First, the surface computer sends a polling signal to request each DSM to respond (step 1401). Each DSM then responds with a known signal magnitude (step 1402). The known signal magnitude for each DSM may be previously stored in the computer. The received signal magnitudes are then used to locate any potential signal attenuation due to loss of coupling efficiency in the WDP joints (step 1403).

Figure 15:
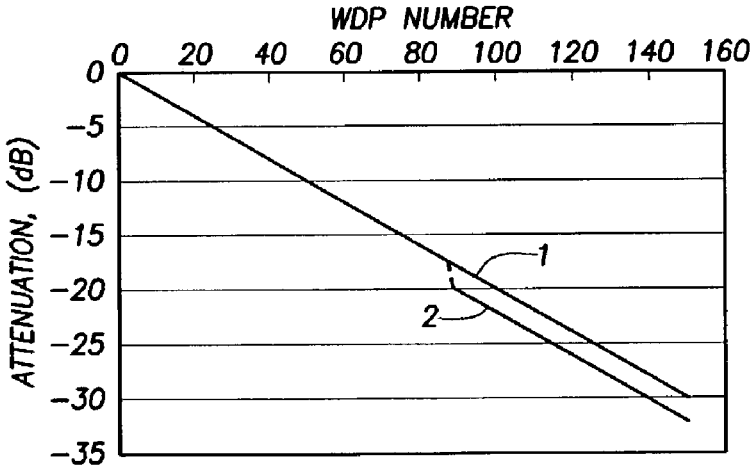
FIG. 15 shows a graph for analyzing coupling efficiencies of WDP telemetry sections in a drill string in accordance with one embodiment of the invention.

FIG. 15 illustrates a method in accordance with embodiments of the invention for locating a potential loss of coupling efficiency at a particular WDP joint using the received signal magnitudes. For simplicity, the analysis assumes that each WDP DSM transmits a signal of a calibrated amplitude (i.e., an identical magnitude). If each WDP attenuates the signal by the same amount (e.g., 0.2 dB), then a plot of the DSM signals versus distance would be linear, as shown by the trace 1 in FIG. 15. Now suppose that the attenuation of the 88th WDP is significantly increased, i.e., partial loss of coupling efficiency. This would create a sudden increase in signal attenuation at that particular location and result in the non-liner trace 2 in FIG. 15. The step change in curve 2 clearly identifies the location of the problematic WDP joint. While FIG. 15 illustrates a method in which the received signal magnitudes are plotted against the distance of the DSM from the surface computer, an alternative is to "normalize" the received signal magnitudes such that each signal is compensated for the expected attenuation before analysis. In this case, all normalized signal magnitudes are expected to have the same value. Any loss of coupling efficiency will manifests itself as a drop of the normalized signal magnitudes beyond the problematic WDP joint. In this alternative approach, there is no need to use a graph or plot for analysis. This approach may be easily adapted to automatic analysis.

One of ordinary skill in the art would appreciate that such analysis does not require that each DSM transmits a signal of the same amplitude. If the amplitudes of the signals from the WDP DSM are known before hand, then the signals received from the DSM can be normalized. Similarly, it is not necessary that each WDP section attenuates the signal to the same extent. Instead, as long as the attenuation of each WDP is known before hand, the received signal magnitudes may be normalized or compensated. Even if the attenuation of each WDP is not known before hand, it can be determined from the signal level of each WDP DSM as each new section of WDP is added to the drill string. Furthermore, even if the attenuation of each WDP is not known or determined, it is possible to monitor any changes in attenuation with time (or with the addition of more WDP) to detect the problematic WDP using embodiments of the invention.

Maintenance and Tracking of WDP

WDP including the DSM of the invention will be easily tracked or inventoried. Because each WDP is uniquely identified by its identifier, shipping and tracking WDP will be relatively simple. To identify or inventory such a WDP, a conventional test box may be used to activate the DSM and record the identifier into a database.

At the rig, the surface computer can automatically record into a database pumping hours, hours below rotary, RPM, GPM, temperature, and pressure for each WDP. This database can be used to schedule inspections, maintenance and repair for each WDP. In addition, the attenuation for each section of WDP can be measured (as discussed above in relation to FIG. 15) and tracked in the database. Any degradation in efficiency may then be used to schedule inspection, maintenance or repair.

Pre-Job and Post-Job Testing

The electrical function of each section of WDP or each stand of WDP (e.g., a triple WDP) can be tested using the DSM in accordance with embodiments of the invention. Test boxes can be attached to the pin or box connection of a WDP. Such a test box would inject current directly across the recess containing the toroid or would induce current using the toroidal transformer. It would communicate to the DSM, thus verifying the integrity of the WDP transmission and the proper operation of the DSM. The test box would record the identifier and the test results. It is not necessary to connect a test box to the end of the WDP containing the DSM. Instead, the test box may be attached to either end for the testing because the DSM will not respond if there is a failure in the link. This makes it possible to test a stand of WDP without physically accessing both ends. This is a significant advantage on the rig where access to both ends of a WDP stand may not be readily available. For example, when a triple stand of WDP is racked in the derrick, it is possible to access the pin connection, but not the box connection, from the rig floor to test all three sections of WDP without leaving the rig floor.

While the invention has been described with respect to a limited number of embodiments, those skilled in the art, having benefit of this disclosure, will appreciate that other embodiments can be devised which do not depart from the scope of the invention as disclosed herein. For example, while the invention has been illustrated using WDP having toroidal inductive couplers, embodiments of the invention can be applied to other systems where there are many series connections. For clarity, the above description assumes that each WDP includes a diagnostic system/module. One of ordinary skill in the art would appreciate that the present invention is not limited to a drilling string, in which every WDP includes a DSM. Instead, drill strings in which some WDPs include DSMs and some do not are expressly within the scope of the invention. Furthermore, embodiments of the invention are not limited to MWD or LWD telemetry, but can also be used for completion strings, testing strings or permanent monitoring installations. Accordingly, the scope of the invention should be limited only by the attached claims.

What is claimed is:

1. A diagnostic module for a downhole drilling tool, comprising:

a line interface adapted to interface with a wired drill pipe telemetry section;

a transceiver adapted to communicate signals between the wired drill pipe telemetry section and the diagnostic module; and a controller operatively connected to the transceiver and adapted to control the transceiver.

2. The diagnostic module of claim 1, further comprising a power supply.

3. The diagnostic module of claim 1, further comprising an isolation measurement circuitry.

4. The diagnostic module of claim 1, further comprising an acquisition module and at least one sensor.

5. The diagnostic module of claim 4, wherein the at least one sensor is one selected from the group consisting of a temperature sensor, a shock sensor, a load sensor and a pressure sensor.

6. A wired drill pipe, comprising:

an elongated tubular shank having an axial bore;

a box end at a first end of the shank, the box end having a first inductive coupler element disposed therein;

a pin end at a second end of the shank, the pin end having a second inductive coupler element disposed therein;

a wire electrically coupling the first and the second inductive coupler elements, wherein the first inductive coupler element, the second inductive coupler element, and the wire constitute a telemetry section of the wired drill pipe; and a diagnostic module electrically coupled to the telemetry section of the wired drill pipe, the diagnostic module comprising:

a line interface adapted to interface with a wired drill pipe telemetry section;

a transceiver adapted to communicate signals between the wired drill pipe telemetry section and the diagnostic module; and a controller operatively connecting the transceiver and adapted to control the transceiver.

7. The wired drill pipe of claim 6, wherein the diagnostic module further comprises an isolation measurement circuitry.

8. The wired drill pipe of claim 6, wherein the diagnostic module further comprises a power supply.

9. The wired drill pipe of claim 6, wherein the first and second inductive coupler elements each comprise a toroidal transformer.

10. The wired drill pipe of claim 6, wherein the diagnostic module electrically couples to the telemetry section by a secondary winding on the first inductive coupler element.

11. The wired drill pipe of claim 6, wherein the diagnostic module electrically couples to the telemetry section by a secondary winding on the second inductive coupler element.

12. The wired drill pipe of claim 6, wherein the diagnostic module electrically couples to the telemetry section by linking to the wire.

13. The wired drill pipe of claim 6, wherein the diagnostic module further comprises an acquisition module and at least one sensor.

14. The wired drill pipe of claim 13, wherein the at least one sensor is one selected from the group consisting of a temperature sensor, a shock sensor, and a pressure sensor.

15. A wired drill pipe comprising:

an elongated tubular shank having an axial bore;

a box end al a first end of the shank, the box end having a first inductive coupler element disposed therein;

a pin end at a second end of the shank, the pin end having a second inductive coupler element disposed therein;

a wire electrically coupling the first and the second inductive coupler elements, wherein the first inductive coupler element, the second inductive coupler element, and the wire constitute a telemetry section of the wired drill pipe; and a connection for testing isolation between the wire and a body of the wired drill pipe, wherein a first end of the connection for testing connects to the wire.

16. The wired drill pipe of claim 15, wherein the connection for testing has a testing pad on a second end.

17. The wired drill pipe at claim 16, wherein the connection for testing further comprises a resistor disposed between the testing pad and the first end.

18. The wired drill pipe of claim 17, wherein the resistor has a resistance of at least one mega ohm.

19. The wired drill pipe of claim 18, wherein the testing pad is exposed.

20. The wired drill pipe of claim 18 wherein the first end is connected to the center of the inductive coupler element.

21. A wired drill pipe telemetry system, comprising:

a surface computer, and a drill string telemetry link comprising a plurality of wired drill pipes each having a telemetry section, at least one of the plurality of wired drill pipes having a diagnostic module electrically coupled to the telemetry section;

wherein the diagnostic module comprises:

a line interface adapted to interface with a wired drill pipe telemetry section;

a transceiver adapted to communicate signals between the wired drill pipe telemetry section and the diagnostic module; and a controller operatively connecting the transceiver and adapted to control the transceiver.

22. The telemetry system of claim 21, wherein the telemetry section comprises a first inductive coupler element at a first end of the wired drill pipe, a second inductive coupler element at a second end of the wired drill pipe, and a wire operatively connecting the first and the second inductive coupler elements.

23. The telemetry system of claim 21, further comprising a measurement assembly attached to the drill string telemetry link.

24. The telemetry system of claim 23, wherein the measurement assembly comprises one selected from the group consisting of a measurement-while-drilling instrument and a logging-while-drilling instrument.

25. The telemetry system of claim 21, further comprising at least one router.

26. The telemetry system of claim 25, wherein the surface computer, the drill string telemetry link, and the at least one router form a network.

27. The telemetry system of claim 26, wherein the network is configured in a topology selected from the group consisting of a bus topology, a ring topology, a daisy chain topology, a linear topology, a star topology, and a hybrid topology.

28. The telemetry system of claim 26, wherein the network is reconfigurable to bypass a selected telemetry section in a wired drill pipe.

29. A method for diagnosing a wired drill pipe telemetry system that comprises a plurality of wired drill pipes, each having a telemetry section, and at least one of the plurality of the wired drill pipes having a diagnostic module, the method comprising:

sending a polling signal from a surface computer to the wired drill pipe telemetry system, the polling signal including a selected identifier;

receiving and processing the polling signal by the diagnostic module in the at least one of the plurality of wired drill pipes; and receiving by the surface computer a reply from a specific diagnostic module having the selected identifier.

30. The method of claim 29, wherein the sending a polling signal, the receiving and the processing the polling signal, and the receiving a reply are repeated for every identifier corresponding to the at least one diagnostic module.

31. The method of claim 29, wherein the receiving by the surface computer involves relaying the reply from the specific diagnostic module by a measurement assembly attached to one end of the wired drill pipe telemetry system.

32. The method of claim 31, wherein the relaying the reply by the measurement assembly occurs after a pre-set time period expires.

33. The method of claim 29, wherein the receiving by the surface computer involves relaying the reply from the specific diagnostic module by a router that is part of the wired drill pipe telemetry system.

34. The method of claim 33, wherein the relaying the response by the router occurs after a pre-set time period expires.

35. A method for tracking a wired drill pipe usage, comprising:

polling a diagnostic module of a wired drill pipe for an identifier when the wired drill pipe is run into a borehole; and logging the identifier for the wired drill pipe.

36. The method of claim 35, further comprising logging a depth information for the wired drill pipe, the depth information being based on a known length of each drill pipe in a drill string and a location of the wired drill pipe in the drill string.

37. The method of claim 35, further comprising logging a usage time for the wired drill pipe.

38. The method of claim 35, further comprising:

instructing the diagnostic module of the wired drill pipe to make measurements while the wired drill pipe is in the borehole; and storing the measurements for the wired drill pipe.

39. The method of claim 38, wherein the measurements comprise one selected from the group consisting of a temperature measurement, a shock measurement, a load measurement and a pressure measurement.

40. A method for diagnosing a failure in a wired drill pipe telemetry system, comprising:

polling a diagnostic module of a wired drill pipe in a drill string; and recording whether a response from the diagnostic module is received by a surface computer.

41. The meted of claim 40, wherein the polling and the recording are performed for each diagnostic module in the drill sting.

42. The method of claim 41, further comprising determining a location of the failure if at least one response is not received.

43. The method of claim 42, wherein the polling, the recording, and the determining are performed when the drill string is in a borehole.

44. The method of claim 42, wherein the polling, the recording, and the determining are performed when the drill string is out of a borehole.

45. A method for determining coupling efficiencies of wired drill pipes in a drill string, comprising:

instructing each of at least one diagnostic module of the wired drill pipes in the drill string to send a signal of a known magnitude to a surface computer;

receiving the signal with a measured magnitude for the each of the at least one diagnostic module; and determining the coupling efficiencies of the wired drill pipes based on the measured magnitude of the signal.

46. The method of claim 45, wherein the determining the coupling efficiencies uses a graph of the measured magnitude versus a distance between the surface computer and the fault diagnosis module.

47. The method of claim 45, wherein the determining the coupling efficiencies comprises adjusting the measured magnitude based on a distance between the surface computer and the diagnostic module to produce a corrected magnitude of the signal; and comparing the corrected magnitude of the signal.

48. The method of claim 45, wherein the drill string is disposed in a borehole.

49. The method of claim 45, wherein the drill siring is out of a borehole.

50. The method of claim 49, wherein the wired drill pipe is part of a drill string that is disposed in a borehole.

51. The method of claim 49, wherein the wired drill pipe is out of a borehole.

52. A method for assessing electrical isolation between a telemetry wire and a pipe body in a wired drill pipe, comprising:

instructing a diagnostic module of the wired drill pipe to send a selected voltage through an isolation measurement circuitry; and determining an electrical property in the isolation measurement circuitry, wherein the electrical property is a resistance, a voltage, or a current.

53. A method of testing a telemetry section, the section comprising a drill pipe having a wire extending therethrough, the method comprising:

providing a telemetry section with a test pad and a resistor, the resistor having a known resistance;

applying a voltage between a test pad and the drill pipe;

measuring a test resistance passing between the test pad and the drill pipe; and detecting a difference between the test resistance and the known resistance whereby the condition of the wired drill pipe is determined.

* * * * *